US006925786B2

(12) United States Patent
Sjöswärd

(10) Patent No.: US 6,925,786 B2
(45) Date of Patent: Aug. 9, 2005

(54) SYSTEM IN CONNECTION WITH A STIRRUP

(75) Inventor: Rolf Sjöswärd, Paradisets väg 21, SE-434 93 Vallda (SE)

(73) Assignee: Rolf Sjöswärd, Vallda (SE)

( * ) Notice: Subject to any disclaimer, the term of this patent is extended or adjusted under 35 U.S.C. 154(b) by 0 days.

(21) Appl. No.: 10/945,983

(22) Filed: Sep. 22, 2004

(65) Prior Publication Data

US 2005/0060967 A1 Mar. 24, 2005

(30) Foreign Application Priority Data

Sep. 22, 2003 (SE) ..... 0302499

(51) Int. Cl.[7] ..... B68C 3/02
(52) U.S. Cl. ..... 54/47; 54/49
(58) Field of Search ..... 54/47–49; 36/131

(56) References Cited

U.S. PATENT DOCUMENTS

| | | | | | |
|---|---|---|---|---|---|
| 2,187,983 | A | * | 1/1940 | Moore | 54/47 |
| 3,905,179 | A | * | 9/1975 | Bischeltsrieder | 54/47 |
| 4,735,107 | A | | 4/1988 | Winkie | |
| 5,172,538 | A | * | 12/1992 | Luger | 54/47 |
| 5,930,986 | A | * | 8/1999 | Meaghan et al. | 54/47 |
| 6,272,773 | B1 | * | 8/2001 | Sjosvard | 36/131 |
| 2003/0140605 | A1 | | 7/2003 | Hsi-Chang | |

FOREIGN PATENT DOCUMENTS

| | | | | |
|---|---|---|---|---|
| DE | 4309826 | A1 * | 9/1994 | B68C/3/02 |
| FR | 002616141 | A1 * | 12/1988 | B68C/3/00 |
| FR | 002753962 | A1 * | 4/1998 | B68C/3/02 |
| GB | 1474192 | * | 5/1977 | B68C/3/00 |
| SE | 449 739 | | 5/1987 | |

* cited by examiner

*Primary Examiner*—Son T Nguyen
(74) *Attorney, Agent, or Firm*—Harness, Dickey & Pierce, P.L.C.

(57) ABSTRACT

The present invention relates to a system for use in connection with a stirrup (5) for controlled positioning of a rider's foot relative to a riding animal by means of the stirrup (5). The system comprises a foot support (3) and a riding boot (1), said stirrup (5) being arranged to carry said foot support (3), which in use is in contact with the lower surface of the riding boot (1). The upper side of said foot support (3) is formed with a first pattern adapted to cooperate with a second pattern formed at the underside of the riding boot (1), said first and second patterns being arranged with cooperating abutments directed so as to prevent the rider's foot from moving horizontally in at least one direction.

12 Claims, 3 Drawing Sheets

SYSTEM IN CONNECTION WITH A STIRRUP

FIELD OF THE INVENTION

The present invention relates to a system for use in connection with a stirrup for controlled positioning of a rider's foot relative to a riding animal by means of the stirrup. The system comprises a foot support and a riding boot, said stirrup being arranged to carry said foot support, which in use is in contact with the lower surface of the riding boot.

BACKGROUND ART

Stirrups are known for use as a foot support while riding together with a saddle on, for example, horses or other riding animals. Furthermore, use is made of a pad between the stirrup and the rider's foot to ensure good friction and shock absorption.

Several types of stirrups and pads having an upper surface with high friction against the rider's foot are available on the market. A problem with this type of stirrup is, however, that earth or clay sticking to the stirrup, the pad or the foot deteriorates the friction of the rider's foot against the stirrup. Additional problems arising in connection with existing stirrups and pads consist in positioning the foot correctly in the stirrup. This may especially be a problem to beginners, which also constitutes a security risk if the rider falls off the horse since it may be difficult for him to set himself free. It may also be difficult to dismount the horse if the rider's foot has slipped too far into the stirrup.

SUMMARY OF THE INVENTION

An object of the present invention is to provide a system for use in connection with a stirrup while riding, which easily allows correct and safe positioning of the rider's foot relative to the stirrup.

Another object of the present invention is to provide a system that reduces the risk of the foot sliding too far into the stirrup.

The above objects and other objects that will be evident from the following description are achieved by a system according to the claims.

The invention is based on the knowledge that it is possible to provide a system for cooperation between the stirrup and the foot by form-fitting.

According to one aspect of the present invention, a system is provided for use in connection with a stirrup for controlled positioning of a rider's foot relative to a riding animal by means of the stirrup. The system comprises a foot support and a riding boot, said stirrup being arranged to carry said foot support, which in use is in contact with the lower surface of the riding boot. The upper side of said foot support is formed with a first pattern adapted to cooperate with a second pattern formed at the underside of the riding boot, said first and second patterns being arranged with cooperating abutments directed so as to prevent the rider's foot from moving horizontally in at least one direction.

Of course, the above-described cooperating patterns can be formed in the riding boot and directly in the foot support of the stirrup, respectively, or the first pattern can be formed in an insert pad which is attached between the stirrup and the riding boot and, like before, the second pattern is formed on the sole part of the riding boot. The patterns on the sole part and the foot support/insert pad fit together, and it is preferably easier for the rider to pull his foot out of the stirrup than insert it into the stirrup since this is prevented by cooperating abutments. Moreover, the cooperating pattern can be repeated periodically in the longitudinal direction of the foot on one or both of riding boot and insert pad in order to provide a possibility of placing the foot in different positions in the stirrup. Said pattern can be formed with different types of cross-sections, such as saw-toothed, square or a soft wave shape. Moreover, the pattern can be formed as one or more male/female couplings such as studs and holes. It goes without saying that the pattern can also be designed for a limited number of positions of the foot relative to the stirrup, for instance only one position. Moreover the first and the second patterns need not fit together like pieces in a jigsaw puzzle, but they can be designed to be in partial contact when cooperating.

Further possibilities presented by the invention involve repeating the cooperating pattern periodically transversely to the direction of insertion of the rider's foot so as to provide controlled positioning of the foot in the lateral direction relative to the stirrup. Also in this case it is possible to use various geometries. If, for instance, only centring of the foot is desired, it is possible to limit the pattern so that it has no periodic repetition in the transverse direction, such as a V-shaped pattern seen from above.

The pattern of the sole part may also consist of a detachable part that can be exchanged or adjusted to different positions. In this way, it is possible to obtain individual setting and/or prolong the life of the riding boot, if the sole part is worn out first.

To provide a suitable angle of the foot relative to the horizontal plane, each period of the periodical pattern is placed at a successively higher level in the direction forwards. Thus the insert pad forms a stairway that gives the foot the desired inclination with the heel in the lowest position. Alternatively, the foot support part of the stirrup is given an inclination to provide a suitable angle of the foot and/or the insert pad relative to the horizontal plane. It is also desirable to be able to control the angle $\alpha$ of the foot (shown in FIG. 3) when placed in the stirrup, which in the first place is achieved by rotating the pattern of the riding boot on the underside of the sole part through an angle $\alpha$. However, it is also possible to adjust the angle of the pattern on the insert pad for rotation of the heel of the foot, usually inwards to the riding animal.

To fasten the insert pad to the stirrup, any conventional method of joining can be used, such as screw/nut, form-fitting or snap joint or some other male/female construction.

The pattern of the sole part of the riding boot and the insert pad is advantageously designed to prevent gravel, earth, clay or other objects that could impair the function from adhering to it. Especially the valleys arising in the pattern are designed to prevent dirt from adhering, for instance by a geometric shape or with a coating of low friction material. If after all dirt should adhere, the pattern is advantageously designed with a geometry that facilitates cleaning.

The insert pad can be made of a number of different materials, such as rubber, plastic, metal or wood. Different material properties can be used, for instance by selecting different materials or combinations of materials, to achieve different functions of the stirrup system. Advantageously the insert pad is made of rubber and a layer of shock-absorbing material can be arranged between the riding boot and the stirrup, for instance, to absorb shocks and increase the rider's comfort.

BRIEF DESCRIPTION OF THE DRAWINGS

The invention will now be described in more detail with reference to the accompanying drawings which by way of example illustrate currently preferred embodiments of the invention.

DESCRIPTION OF PREFERRED EMBODIMENTS

Figure 1:
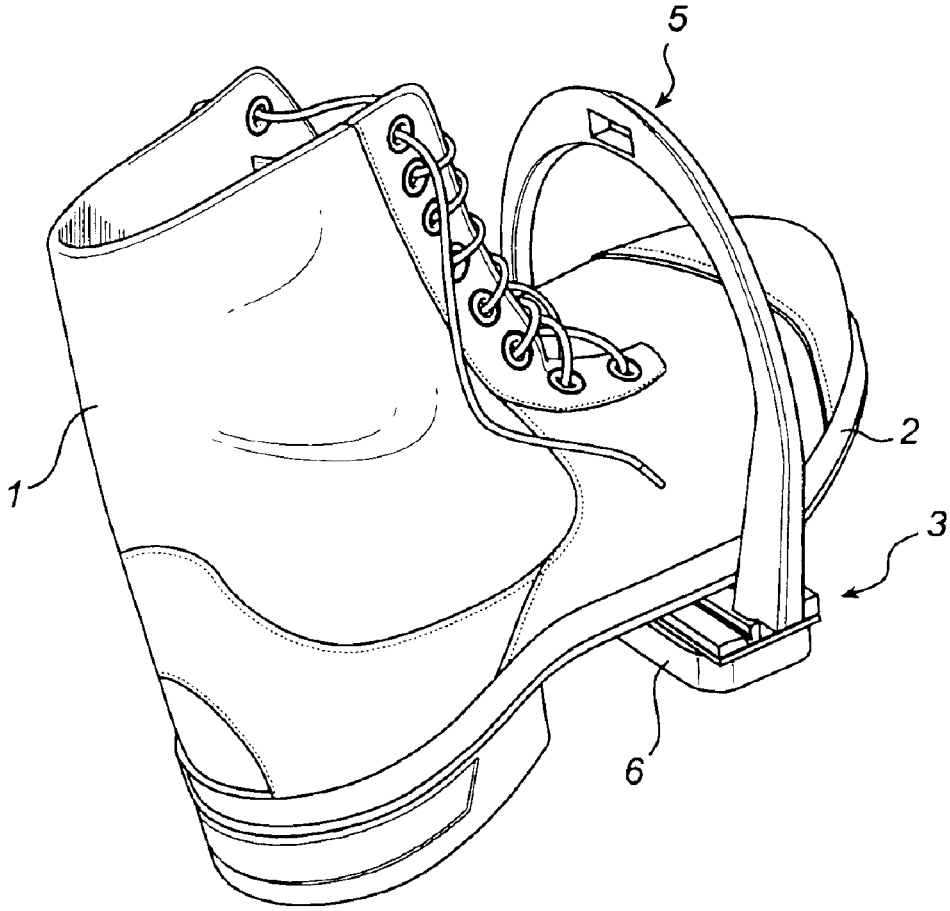
FIG. 1 is a perspective view of a system according to the invention with a riding boot, a stirrup and an insert pad.

The system in FIG. 1 shows a preferred embodiment of the invention in the use position.

Figure 2:
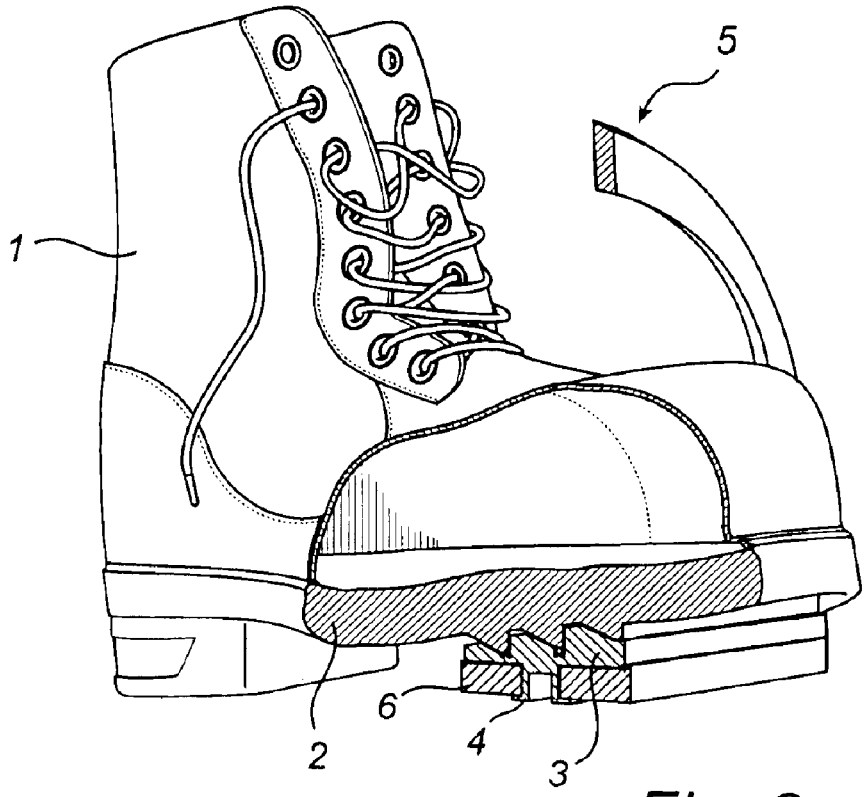
FIG. 2 is a perspective view, partially in cross-section, of a riding boot, a stirrup and an insert pad designed according to the invention.
Figure 3:
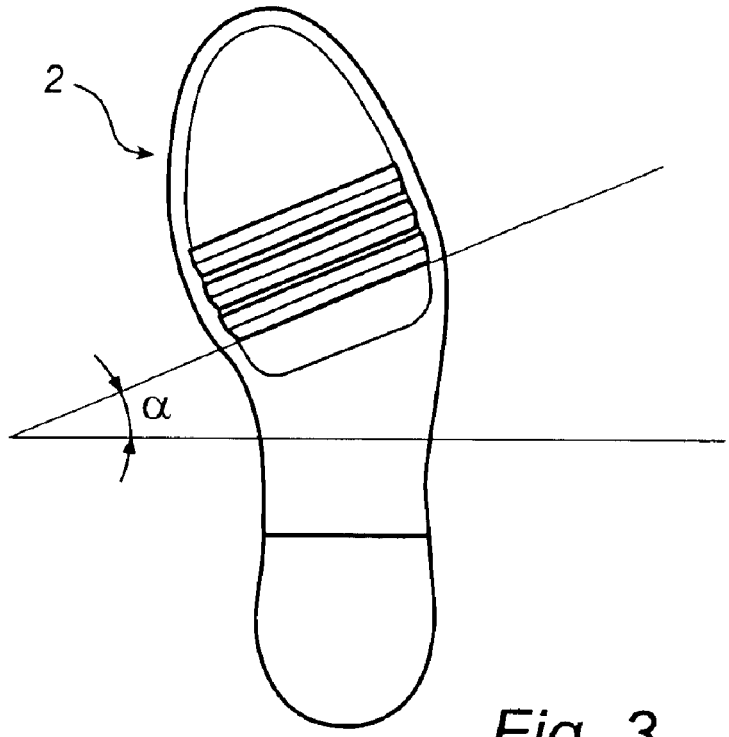
FIG. 3 is a plan view from below of a riding boot according to the invention with the cooperating pattern rotated through an angle α relative to the riding boot.

FIG. 2 shows the stirrup system according to FIG. 1 with a riding boot 1 comprising a sole part 2, which in use is engaged with the foot support/insert pad 3 via a cooperating saw-toothed pattern formed at the underside of the sole part 2 and with a corresponding pattern on the upper side of the foot support/insert pad 3. Said saw-toothed pattern is arranged on the underside of the front part of the riding boot 1 and extends essentially transversely to the longitudinal direction of the rider's foot from one side of the sole part 2 to the other side, as shown in FIG. 3. The insert pad 3 is attached to the upper side of the foot support part 6 of the stirrup 5, which foot support part has an elongate hole through which the fastening element 4 of the insert pad 3 extends with resilient arms for form-fitting to the stirrup 5. The upper side of the insert pad 3, which engages the riding boot 1, is arranged with a pattern matching the saw-toothed pattern of the sole part 2.

FIG. 3 shows how the pattern on the underside of the sole part 2 can be rotated through an angle α to achieve a desired angle of the rider's foot relative to the stirrup 5. It is also evident that, in this preferred embodiment, three saw teeth are arranged on the sole part 2 and on the insert pad 3, respectively.

Figure 4A:
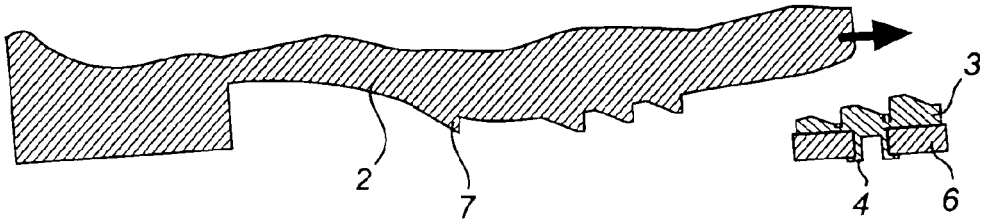
FIG. 4*a* is a schematic cross-section through the riding boot, the stirrup and the insert pad as the rider's foot approaches the stirrup.
Figure 4B:
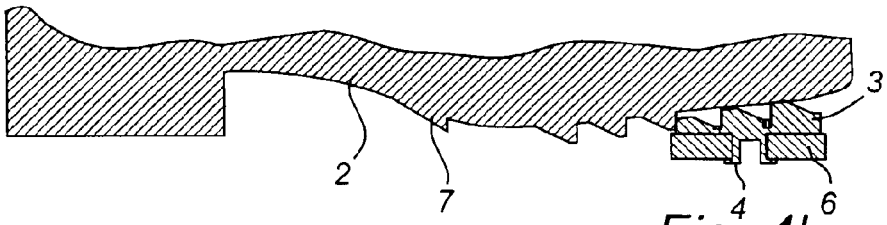
FIG. 4*b* is a schematic cross-section through the riding boot, the stirrup and the insert pad with the foot engaged with the insert pad in a rear position.
Figure 4C:
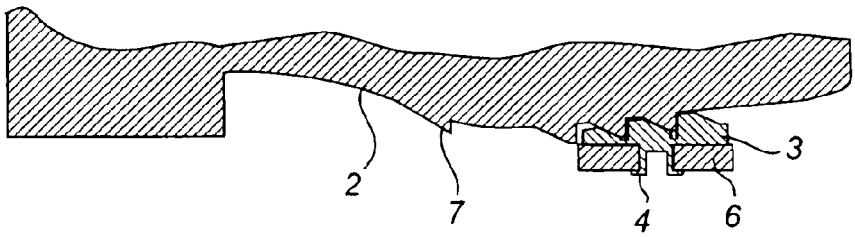
FIG. 4*c* is a schematic cross-section through the riding boot, the stirrup and the insert pad when the foot is engaged in an intermediate position.
Figure 4D:
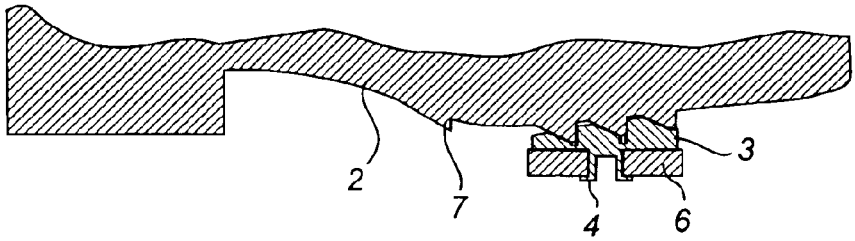
FIG. 4*d* is a schematic cross-section through the riding boot, the stirrup and the insert pad when the foot is engaged in a front position.

FIG. 4*a* illustrates how the sole part 2 of the riding boot 1 is moved towards the insert pad 3 and the foot support part 6 of the stirrup 5, and in the next step (FIG. 4*b*) the sole part 2 comes into contact with the insert pad 3. To move the foot further forwards, the sole part 2 must be raised somewhat relative to the insert pad 3, after which the sole part 2 can be fitted in different positions in the stirrup 5 (FIGS. 4*c* and 4*d*).

Said pattern of the insert pad 3 is preferably saw-toothed where one surface is directed backwards and essentially vertical, thus locking by form-fitting to the corresponding abutments of the sole part 2 if the rider tries to move his foot in the horizontal direction forwards without raising it. The other surface of the saw tooth which is inclined to the horizontal plane from behind forwards makes it easy to pull out the foot from the stirrup 5 since the inclination of the surface cooperates with the corresponding inclined surface of the sole part 2 and, thus, helps the rider in raising the sole part 2 over the tip of the saw teeth when moving his foot backwards out of the stirrup 5.

The pattern of the sole part is preferably located adjacent to the front half of the rider's foot to support the foot at the point where the rider wants to have contact with the stirrup.

In the preferred embodiment of the invention there is also a rear abutment 7 on the sole part 2 which is arranged to limit the insertion of the rider's foot into the stirrup 5 and, thus, prevent the foot from getting too far into the stirrup 5.

The insert pad 3 can advantageously be arranged with a layer of shock-absorbing material between the riding boot 1 and the foot support part 6 of the stirrup 5 to increase comfort and achieve satisfactory engagement between the insert pad 3 and the stirrup 5. An advantage of the saw-toothed pattern in the preferred embodiment is that the rider can walk comfortably in his riding boot 1 without being obstructed by the pattern on the underside of the sole part 2.

What is claimed is:

1. A system for use in connection with a stirrup for controlled positioning of a rider's foot relative to a riding animal, comprising:

a foot support; and a riding boot, said stirrup being arranged to carry said foot support, which in use is in contact with the lower surface of the riding boot, wherein the upper side of said foot support is formed with a first pattern adapted to cooperate with a second pattern formed at the underside of the riding boot, said first and second patterns being arranged with cooperating abutments directed so as to reduce movement of a foot of the rider in at least one direction, and wherein the first pattern of said foot support includes at least a step part directed upwards including, at least partially, a surface inclined from the horizontal plane at an angle, and a step part directed backwards being essentially vertical.

2. A system for use in connection with a stirrup as claimed in claim 1, wherein said foot support consists of an insert pad, said stirrup having a foot support part arranged for releasable connection to the insert pad, which is adapted to be arranged essentially between the foot support part of the stirrup and the lower surface of the riding boot.

3. A system for use in connection with a stirrup as claimed in claim 2, wherein said first and second patterns are designed so as, when cooperating, to allow the rider to more easily remove his foot from the stirrup compared with inserting it into the stirrup.

4. A system for use in connection with a stirrup as claimed in claim 1, wherein said first and second patterns are designed so as, when cooperating, to allow the rider to more easily remove his foot from the stirrup compared with inserting it into the stirrup.

5. A system for use in connection with a stirrup as claimed in claim 1, wherein the height of the steps increases in a forward direction.

6. A system for use in connection with a stirrup as claimed in claim 1, wherein the cooperating first and second patterns of the foot support and the riding boot, respectively, in use allow at least two positions for individual positioning of how far into the stirrup the rider's foot is to be inserted.

7. A system for use in connection with a stirrup as claimed in claim 1, wherein a stop is arranged to limit the insertion of the rider's foot too far into the stirrup.

8. The system of claim 7, wherein the stop is an abutment on the underside of the riding boot.

9. A system for use in connection with a stirrup as claimed in claim 1, wherein said cooperating first and second patterns are arranged for positioning the riding boot rotated through an angle essentially in the horizontal plane, relative to the normal of the foot support part of the stirrup.

10. A system for use in connection with a stirrup as claimed in claim 1, wherein said foot support includes an insert pad, an engagement surface of the insert pad,—engaging the foot support part of the stirrup,—is inclined backwards at an angle to the horizontal plane.

11. A system for use in connection with a stirrup as claimed in claim 1, wherein at least one of said first and second patterns is repeated periodically transversely to the direction of insertion of the rider's foot.

12. A system for use in connection with a stirrup as claimed in claim 1, wherein said foot support is arranged with a layer of shock-absorbing material.

* * * * *